US005426845A

United States Patent [19]

Weideman

[11] Patent Number: 5,426,845

[45] Date of Patent: Jun. 27, 1995

[54] METHOD OF MAKING A GRADIENT COIL ASSEMBLY

[76] Inventor: Marc K. Weideman, 43365 Jerome Ave., Fremont, Calif. 94539

[21] Appl. No.: 18,784

[22] Filed: Feb. 17, 1993

[51] Int. Cl.[6] ..... H01F 41/02

[52] U.S. Cl. ..... 29/602.1; 336/200

[58] Field of Search ..... 29/602.1, 605, 598; 336/200

[56] References Cited

U.S. PATENT DOCUMENTS 3,769,698 11/1973 Lademann et al. ..... 29/602.1

*Primary Examiner*—Carl E. Hall

*Attorney, Agent, or Firm*—Limbach & Limbach

[57] ABSTRACT

A magnetic gradient coil assembly has a plurality of x, y and z gradient coils arranged concentrically about a cylinder. A second coil assembly is formed about the first coil assembly and having the same axis as the axis of the first coil assembly. The second cylindrical coil assembly also has x, y and z gradient coils.

4 Claims, 12 Drawing Sheets

METHOD OF MAKING A GRADIENT COIL ASSEMBLY

BACKGROUND OF THE INVENTION

1 . Field of the Invention

The present invention relates to magnetic coil assemblies and in particular to magnetic coil assemblies and the method of assembling the same for applications of magnetic resonance imaging.

2. Prior Art

Magnetic resonance imaging has developed as an important diagnostic technique for internal injuries and diseases. Magnetic resonance imaging requires several types of magnetic fields. In particular one magnetic coil assembly is required for providing a uniform magnetic field. Additionally, a magnetic coil is required to provide a gradient magnetic field within and superimposed upon the uniform magnetic field.

A typical gradient coil is an assembly of coils which provides magnetic gradients along x, y, and z axis. A second coil assembly is typically arranged concentrically around the gradient coil assembly to provide shielding for the interior or active coil assembly. It is very important that the two coil assemblies be concentrically arranged about a common axis and have exact circular cross-sections. Typically, this involves difficult alignment techniques. More specifically, it involves aligning pre-assembled primary and shield coil assemblies.

OBJECTS OF THE INVENTION

An object of the invention is to provide an improved gradient coil assembly for magnetic resonance imaging applications.

Another object of the invention to provided a shielded gradient coil having an accurate circular cross-section.

Another object of the invention is to provide an improved method of assembling a gradient coil assembly which is easier and less costly than prior techniques.

Another object of the invention is to provide a method of fabricating a gradient coil assembly which has a circular cross section to a high degree of accuracy.

Another object of the invention is to provide a method of manufacturing a gradient coil having two coil assemblies forming the gradient coil which are concentric about a common axis to a high degree of accuracy.

BRIEF DESCRIPTION OF THE INVENTION

DESCRIPTION OF THE PREFERRED EMBODIMENTS

Figure 1:
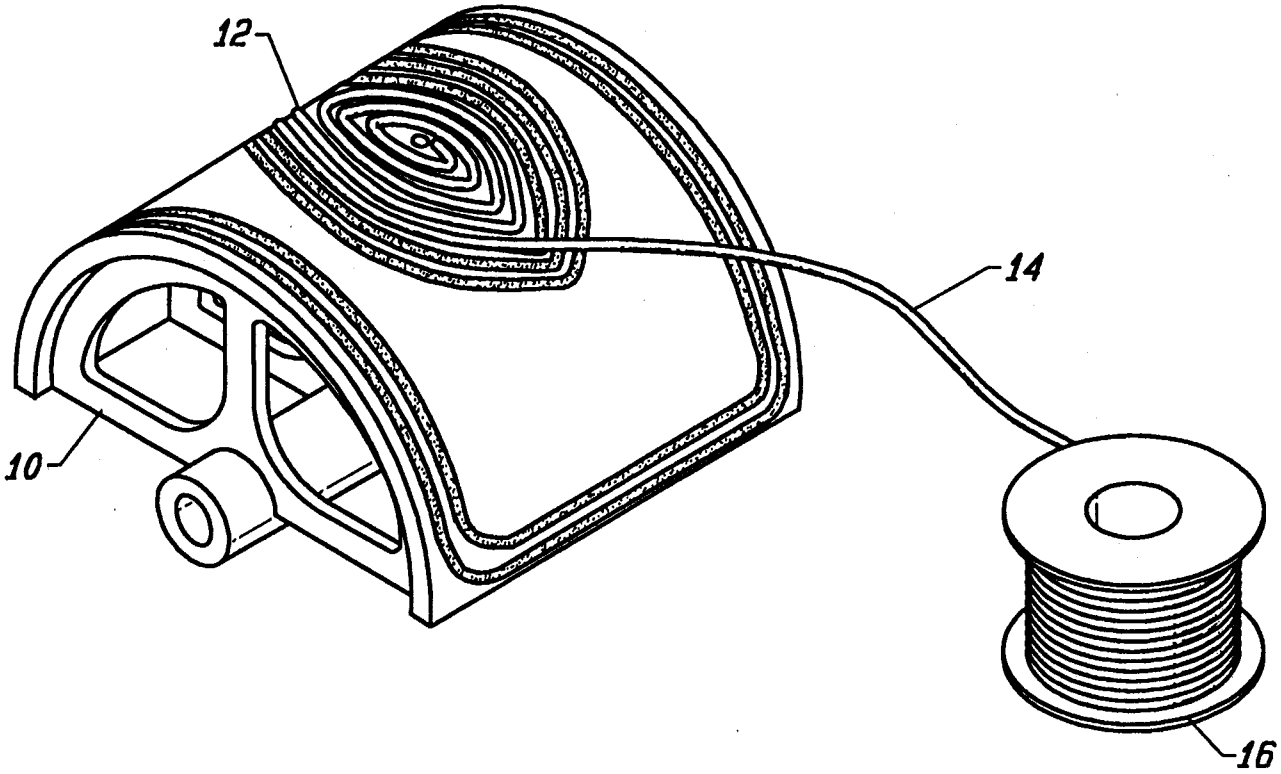
FIG. 1 illustrates the step of forming the x and y magnetic coils for the gradient coil assembly of the present invention.

FIG. 1 illustrates the step of forming the coils which provide the gradient magnetic field along the x and y axis. A mandrel 10 is provided in the form of half of a cylinder. Provided in the circumferential surface of mandrel 10 is a spiral groove 12 which is used to form the x and y coils. The same mandrel 10 and the groove 12 are used to make both the x and y coils, as is well known to those skilled in the art. In one actual embodiment the mandrel 10 was made from aluminum. Wire 14 from a spool 16 is threaded into the spiral groove pattern 12 as shown. In one actual embodiment the wire is no. 2 gauge copper, having a square cross-section.

Figure 2:
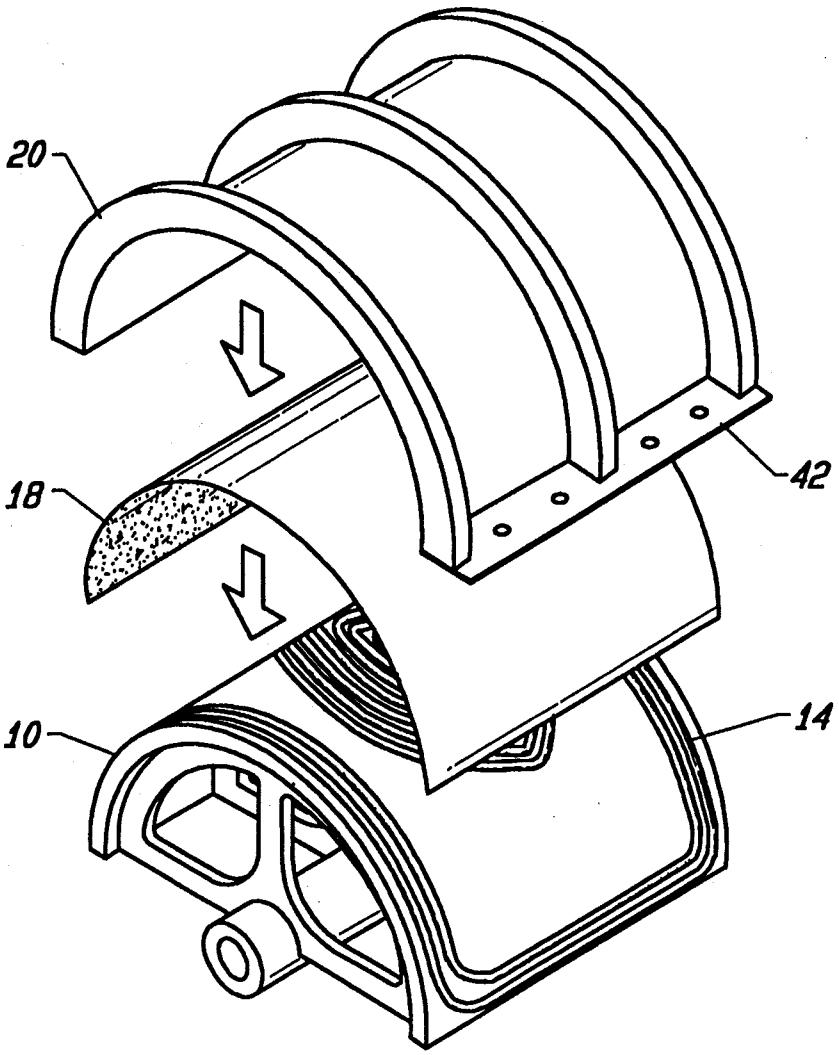
FIG. 2 illustrates the step of casting each of the x and y coils formed in FIG. 1.
Figure 3:
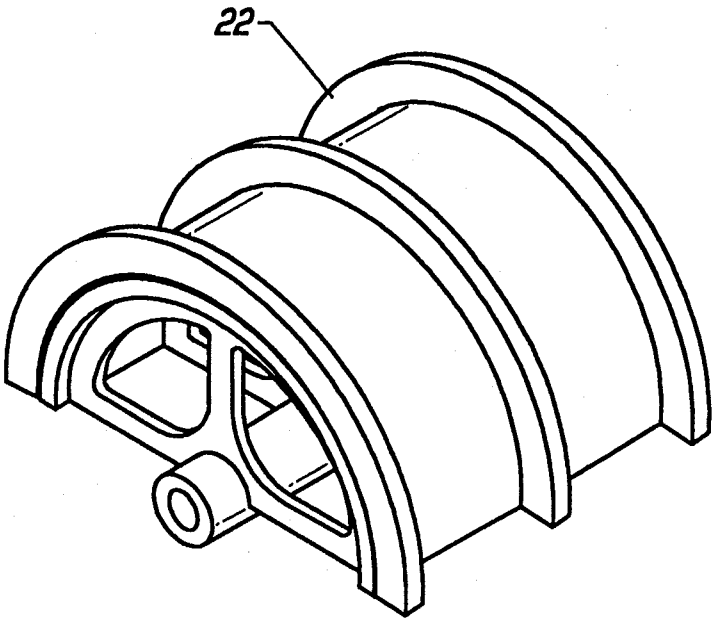
FIG. 3 illustrates the step of curing the coil/fiberglass assembly of FIG. 2.

FIG. 2 illustrates the step of casting each of the x and y coils. In one actual embodiment a total of 16 of these castings is made. Mandrel 10 is shown with the wire 14 filling the groove pattern for the desired coil geometry, sometimes referred to as the "thumbprint". Placed upon the coil/mandrel 10 is a curved section 18, having a C-shaped cross section. This is pre-impregnated, pre-cured fiberglass section made of resin/fiberglass cloth, made in a manner well-known to those skilled in the art. A cover 20 fits securely over the fiberglass section 18 and mandrel 10. It is desirable to machine the cover 20 to a tolerance of 0.005 in. to assure a circular cross section. FIG. 3 shows the assembled parts of FIG. 2. In this manner the coil/fiberglass assembly is heated and cured. This causes the wire 14 to adhere to the fiberglass section 18 forming the coil/fiberglass assembly.

Figure 4:
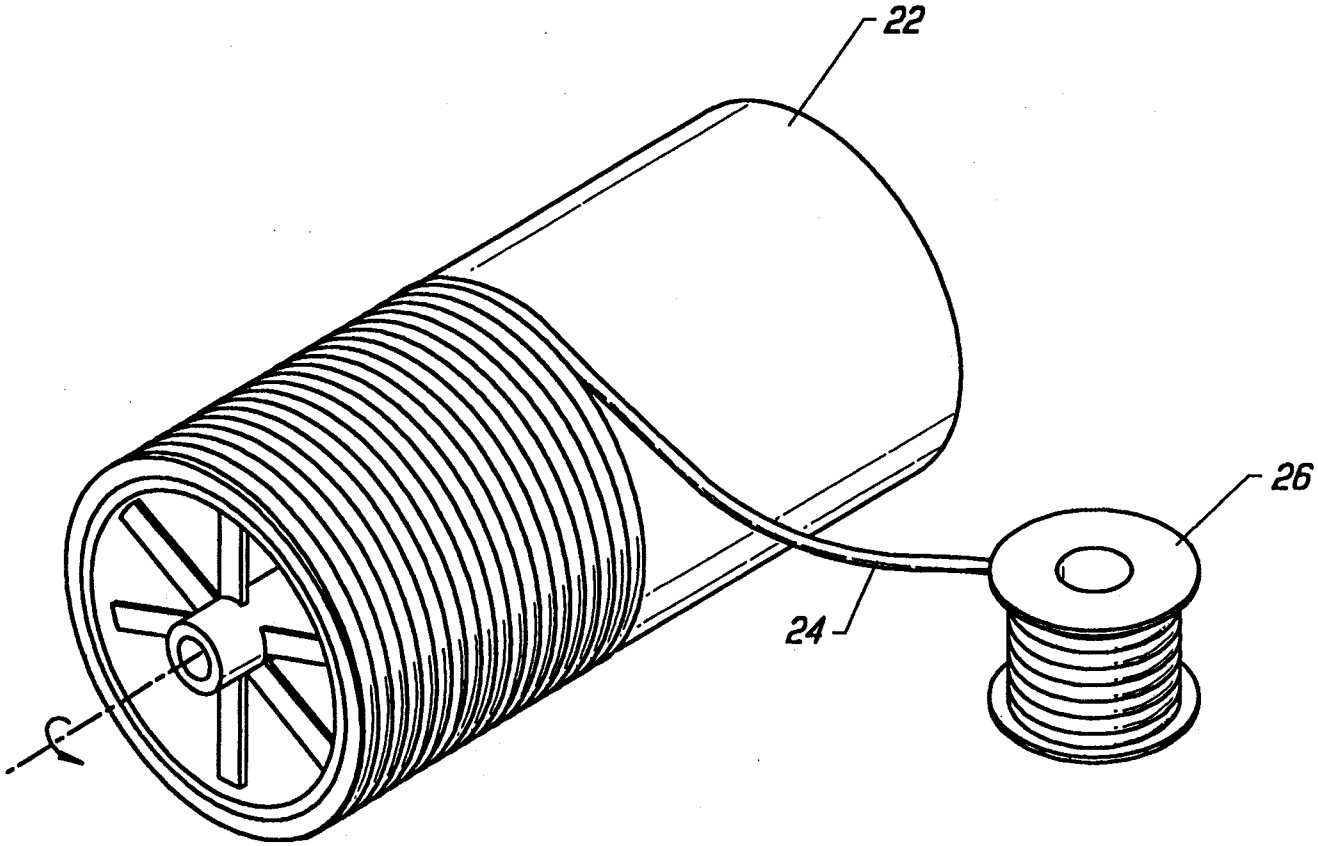
FIG. 4 shows the step of winding a fiberglass tape on a cylindrical mandrel.

The next step is to form a fiberglass tube or cylinder. In FIG. 4 a cylindrical mandrel 22 is rotated so that a resin impregnated fiberglass tape 24 is payed out from a spool 26 onto the mandrel 22. In one actual example the thickness of the fiberglass tape 24 was selected so as to form a cylinder with a ⅛ inch thickness. Once the fiberglass tape 24 is fully wound on the mandrel 22, the assembly is heated and cured forming a fiberglass tube 28.

Figure 5:
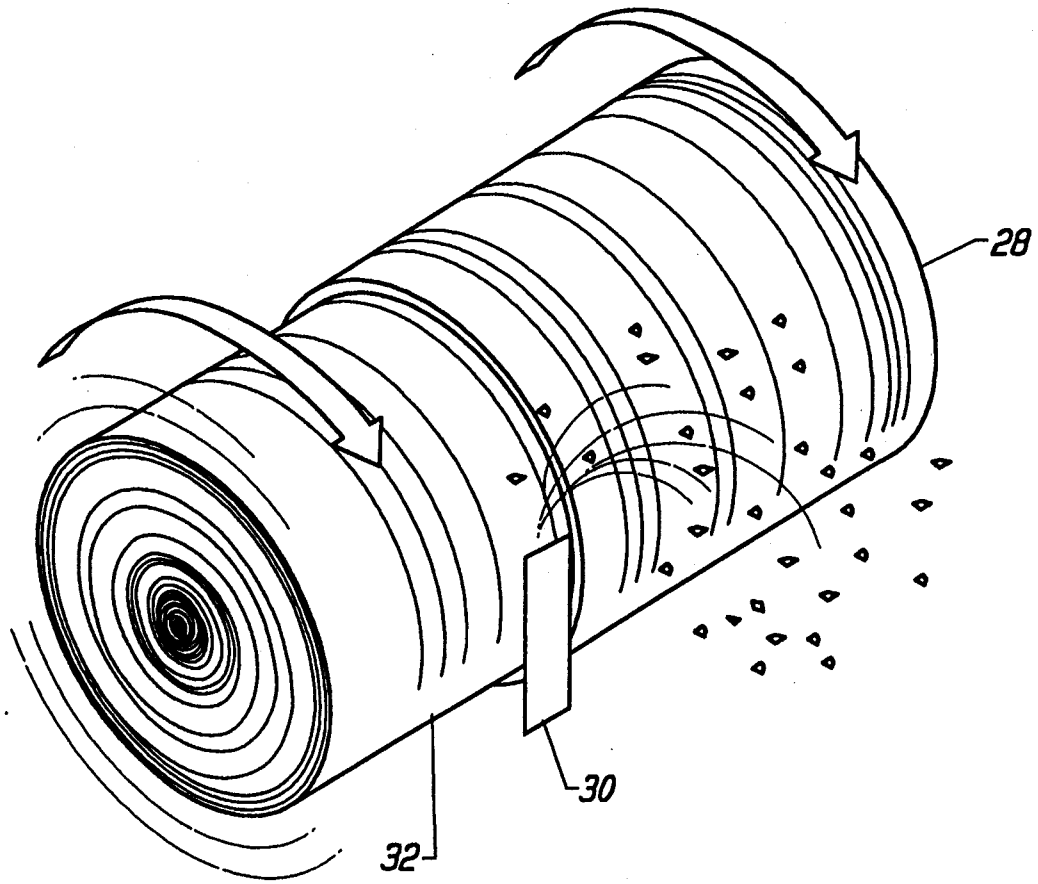
FIG. 5 shows the step of machining the resulting cured cylindrical mandrel.

Next the cured fiberglass tube 28 is put on a lathe, rotated, and machined by a lathe cutting tool 30, as shown in FIG. 5. The tube 28 is machined to within 0.005 inches of a perfect circle to form a cylinder 32.

Figure 6:
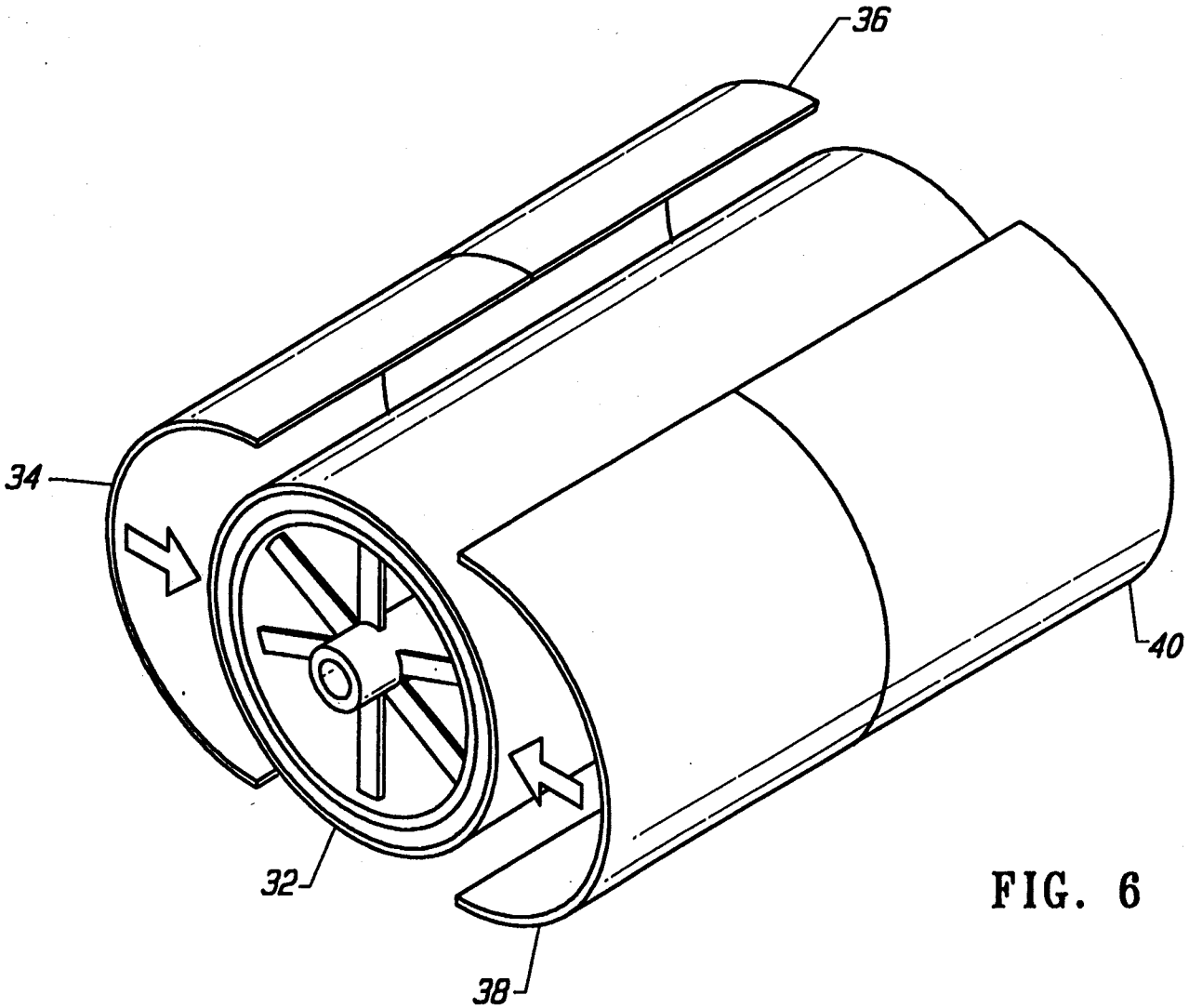
FIG. 6 shows the step of assembling the x coil sections on the fiberglass tube.

The next step is to assemble the x-coils on the cylinder 32. Four coil sections 34, 36, 38 and 40, each made in the manner described in connection with FIGS. 1 and 2, are placed so as to surround the cylinder 32, as shown in FIG. 6. The same covers 20, shown in FIG. 2, are used to hold the coil sections 34, 36, 38 and 40 and cylinder 32 in place. More specifically, 2 pairs of covers 20 are used with each pair being bolted together at the flanges 42 (see FIG. 2). Prior to attaching the covers 20, a fiberglass resin is first painted on the cylinder 32 and the x-coil sections 34, 36, 38 and 40 are put in place and then the assembly is air-cured for 3–6 hours.

Figure 7:
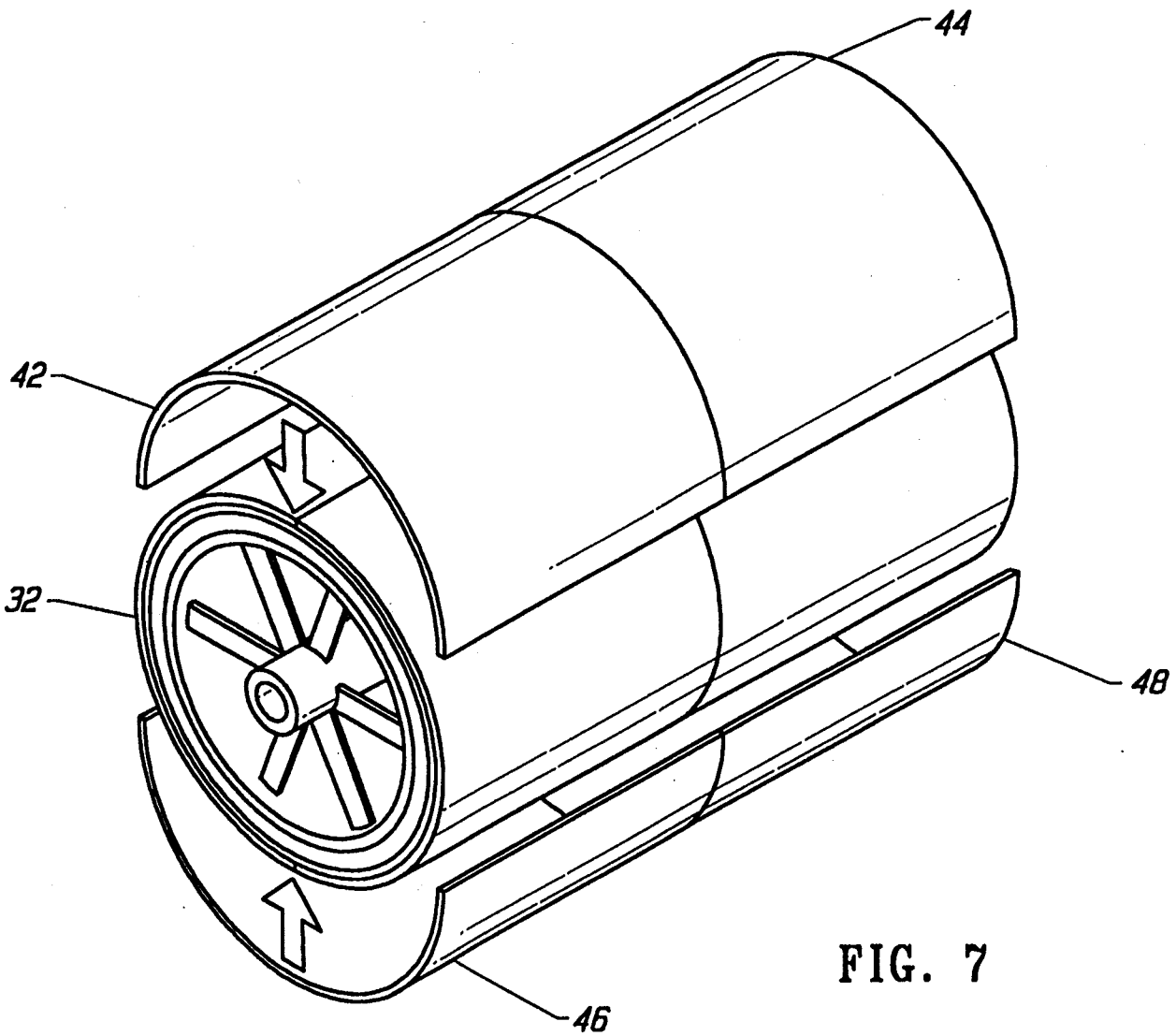
FIG. 7 shows the step of assembling the y coil sections on top of the x coil sections.

Four y-coil sections, each made in the manner described in connection with FIGS. 1 and 2, are next assembled as shown in FIG. 7. The y-coil sections are assembled in the identical manner as the x-coil sections, except that they are assembled 90 degrees around the circumference from the x-coil sections forming an assembly 50.

Figure 8:
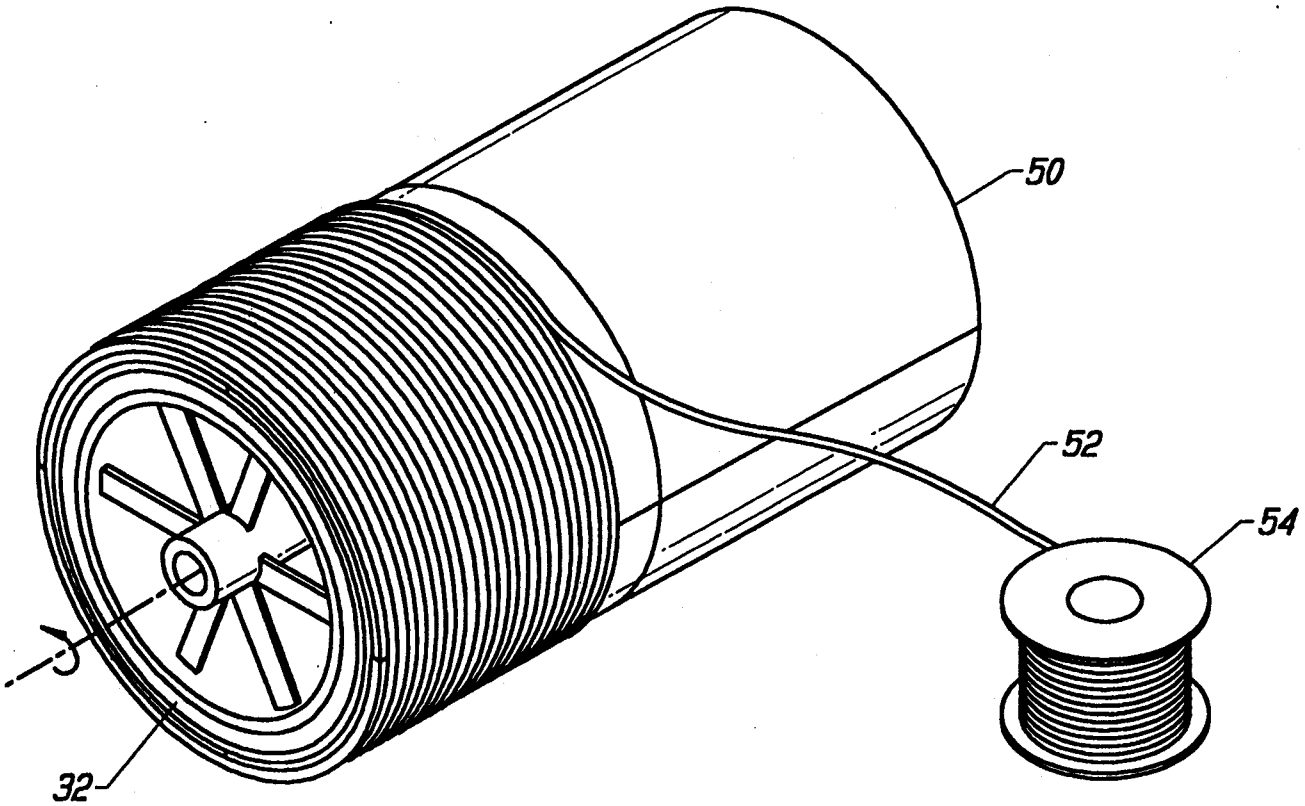
FIG. 8 shows the step of forming the z coil over the cylindrical assembly of the x and y coils.

The next step is to form the z-axis coil. The z-axis is the axis of the cylinder 32. This is accomplished as shown in FIG. 8. First, fiberglass resin is applied over the assembly 50. The assembly 50 is then rotated so that the z-coil wire 52 is payed from wire spool 54. In one actual example, the z-coil wire 52 is 4 gauge copper, and like the x and y wire is insulated with a square cross-section. Once the z-coil wires 52 have been placed on the assembly 50, cooling tubes 56 (FIG. 9) are then spooled onto and over the assembly. In one example, the water tubes 56, used to permit the passage of cooling water, are made of teflon, with a ¼ inch inside diameter and a 5/16 inch outside diameter. The assembly 50 with the water tubes 56 form an assembly 58.

Figure 9:
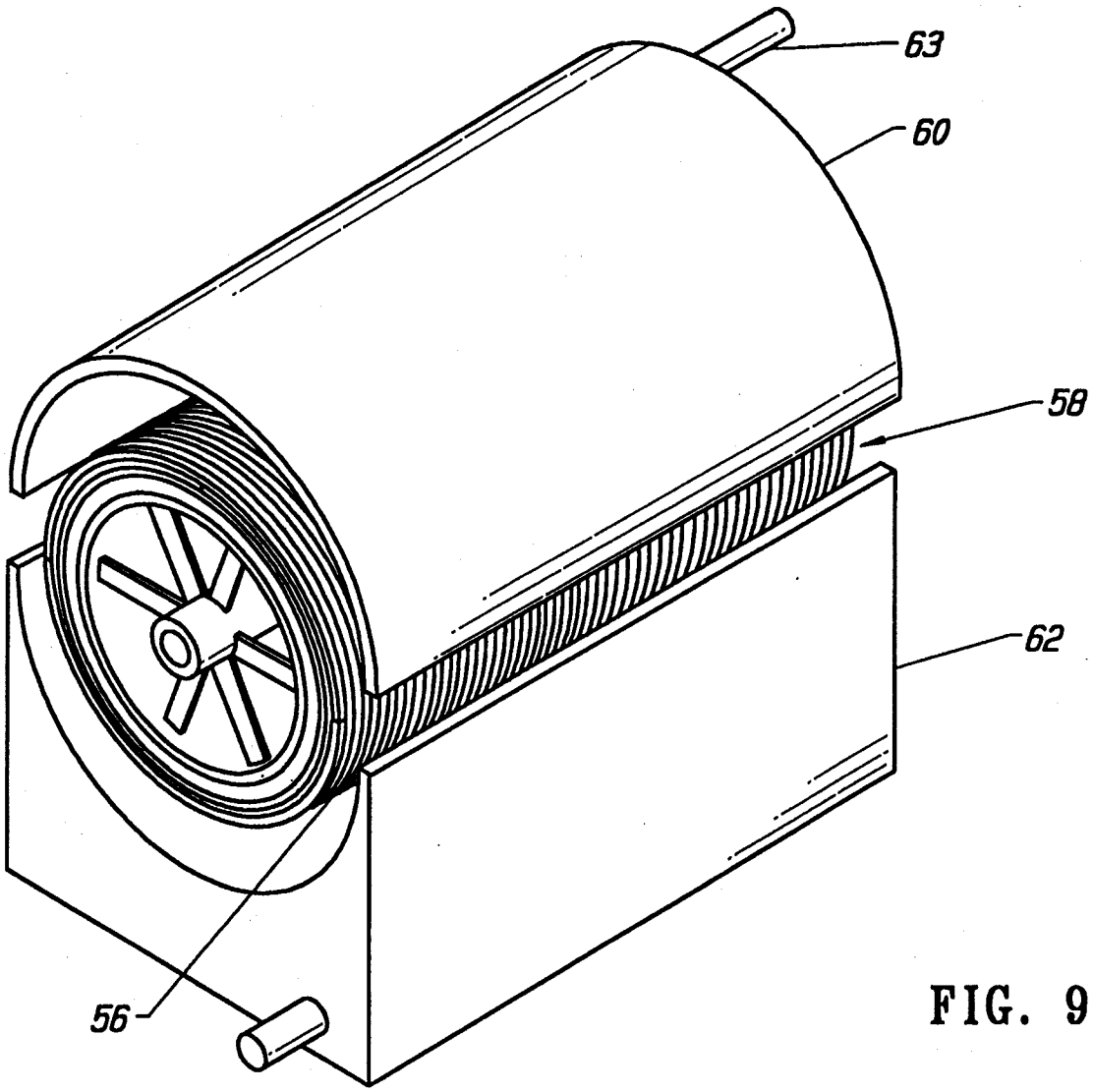
FIG. 9 illustrates the step of forming the first fiberglass cast.

The next step is to form a fiberglass cast over the assembly described in the previous paragraph, and denoted 58 in FIG. 9. An intermediate mold, having an upper half 60 and a lower half 62 is placed around the assembly 58. When clamped in place (not shown) sufficient space is left for the addition of fiberglass resin which enters in port 63. The addition of the fiberglass resin to the assembly 58 forms a cast 64.

Figure 10:
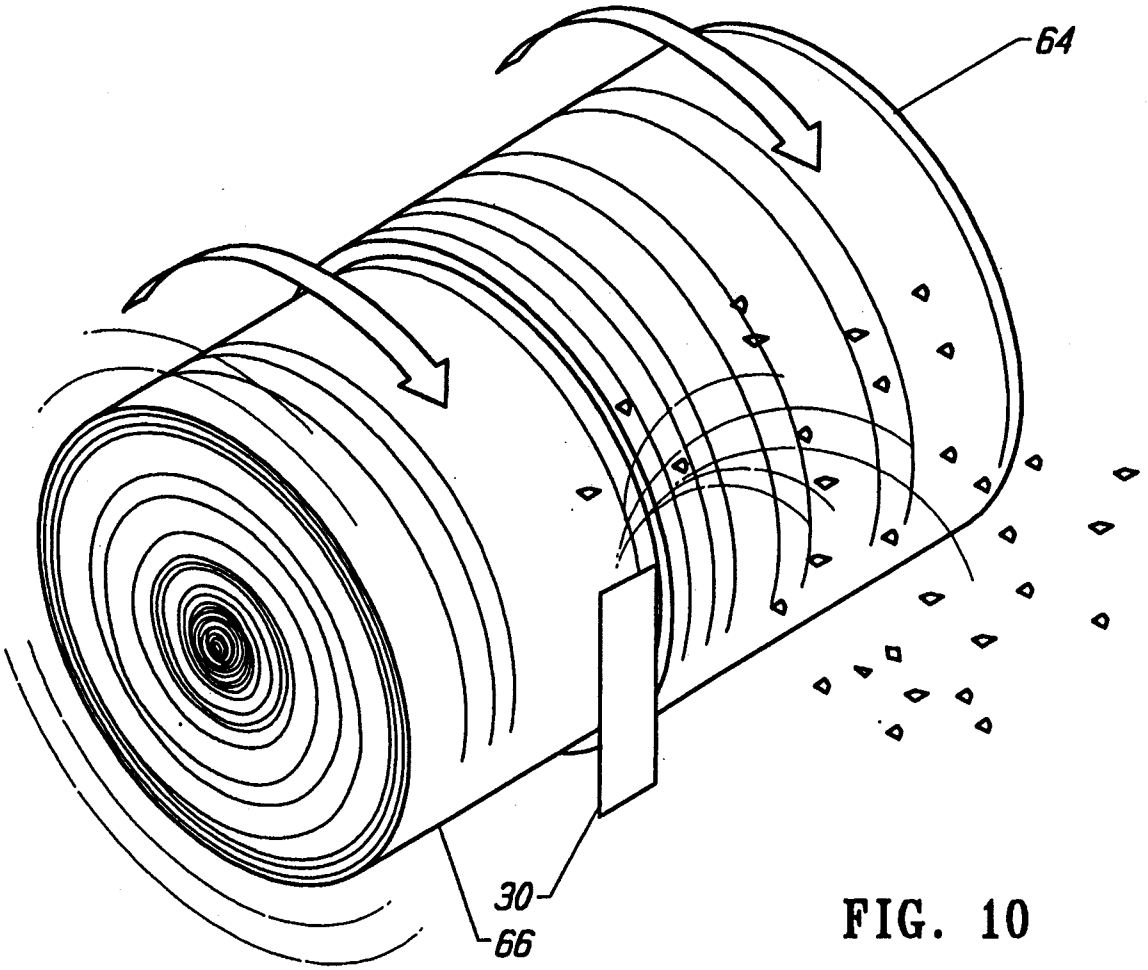
FIG. 10 illustrates the resulting cast after the machining step illustrated in FIG. 9.

The resulting cast 64 is shown in FIG. 10. The cast 64 contains the primary or active gradient coils x, y, and z. This cast 64 is now machined on a lathe in the identical manner as described in connection with FIG. 5 to within 0.008 in. of perfect round to form an active coil assembly 66.

Figure 11:
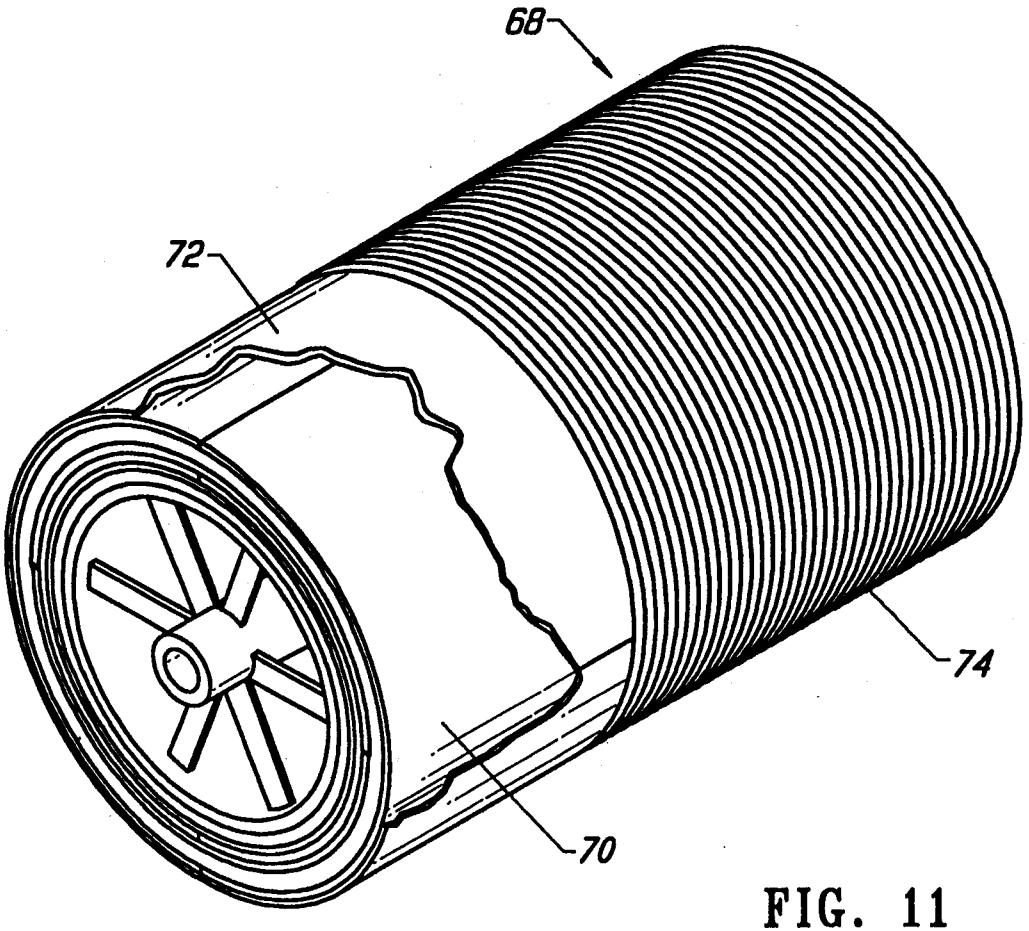
FIG. 11 illustrates the fabrication of the second or shield coil assembly surrounding the first or active coil assembly.
Figure 12:
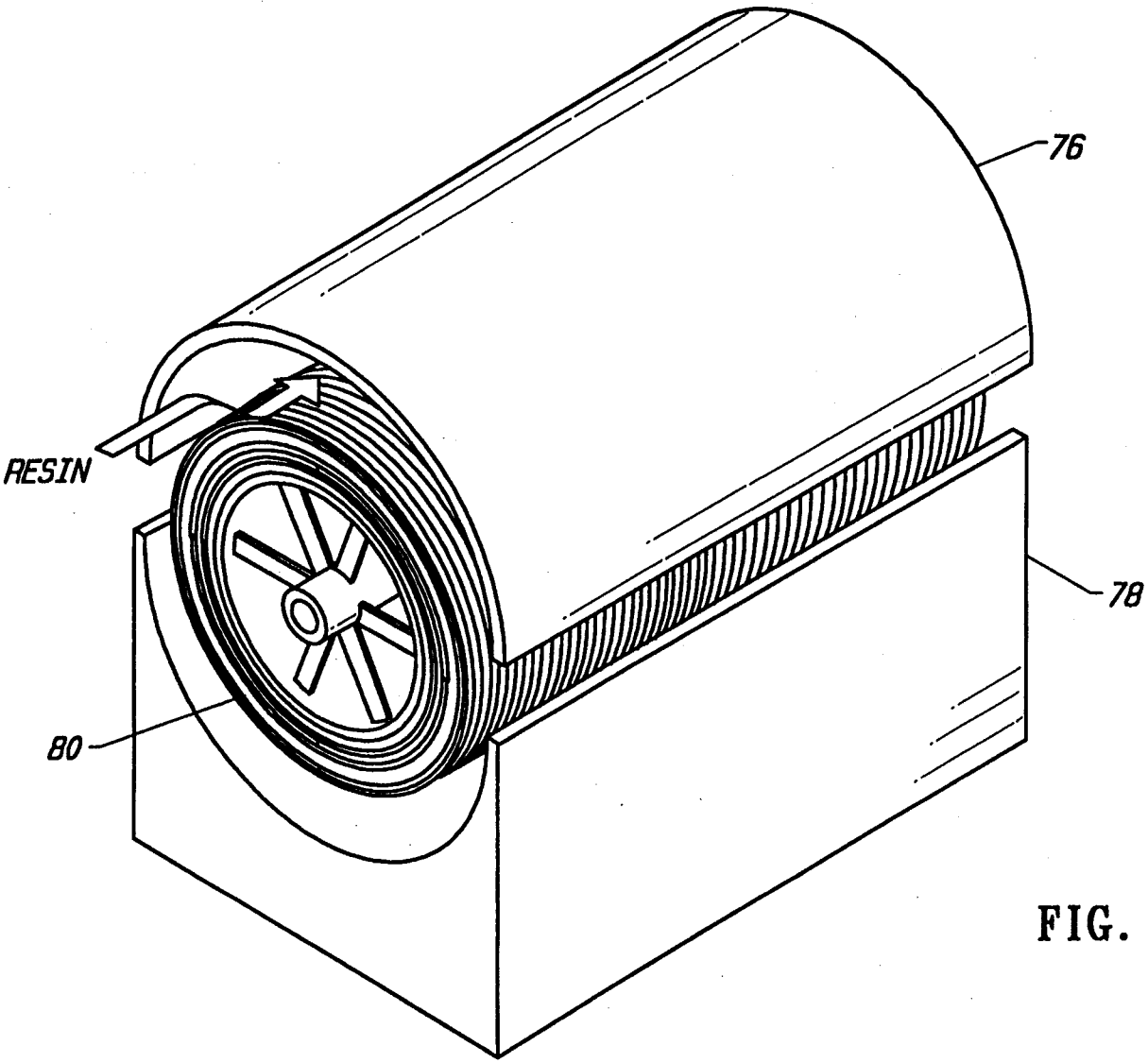
FIG. 12 illustrates the final casting step.

The second or shield coil assembly is fabricated in the identical manner as described above for the active coil assembly 66, as shown in FIG. 11. Because the x-shield coil sections 70, y-shield coil sections 72 and z-coil 74 are formed directly over and surround the active coil assembly 66, concentricity and accurate roundness of the coils is assured. Both the active and shield coil assemblies will have identical axis.

The final casting step is shown in 12. It is identical to the casting step shown in FIG. 9, with the use of a final mold having an upper half 76 and a lower half 78. The resulting cast will encase a complete gradient coil assembly having both active and shield coil assemblies.

The casting resin used in one actual embodiment is 50 parts by weight of Shell (tm) EPON 826, which is mixed with 50 parts by weight of Dow-Corning (tm) DER 736. This mixture, which is the resin, is mixed with a curing agent which is Uniroyal Chemical (Tm) TONOX. During the curing cycle it is cured for 6–8 hours at 140 degrees F. A second stage cure occurs at 180 degrees F. for 6–8 hours.

What is claimed is:

1. A method of making a gradient coil assembly comprising the steps of:

laying up and curing fiberglass with resin to form a first cylindrical tube on a mandrel whose axis defines a z-axis;

machining said cylindrical tube to form a first cylinder with a circular cross-section within predetermined limits;

attaching circumferentially fitting first sections around said mandrel which contain coils therein that, when energized, define a magnetic field oriented along an x-axis, said x-axis being orthogonal to said z-axis;

attaching circumferentially fitting second sections around said mandrel and oriented 90 degrees with respect to said first sections which contain coils therein that, when energized, define a magnetic field oriented along a y-axis, said y-axis being orthogonal to said z-axis;

forming a coil around the circumference of the mandrel and around the first and second sections which when energized forms a magnetic field along the z-axis;

casting a second cylindrical tube over the structure formed by the preceding steps;

machining said second cylindrical tube to form a second cylinder with a circular crosssection within predetermined limits; and performing the third, forth and fifth steps above to create a second coil assembly whose axis is substantially identical to that of said first coil assembly.

2. The method of making a gradient coil assembly of claim 1 including the additional steps of pre-fabricating said first and second sections.

3. The method of making a gradient coil assembly of claim 2 including the steps of forming spiral-shaped coils in said first and second sections.

4. A method of making a magnetic gradient coil for magnetic resonance applications comprising:

forming a first set of three magnetic field coils having orthogonal x, y, and z magnetic axes on a cylinder to form a first magnetic coil assembly, wherein the z axis is substantially coincident with an axis of the cylinder; and forming a second set of three magnetic field coils having orthogonal x, y, and z magnetic axes around said first magnetic coil assembly to form a second magnetic coil assembly wherein the z axis of said first magnetic coil assembly is substantially coincident with the z axis of said second magnetic coil assembly.

* * * * *